US006702410B2

(12) United States Patent
Kusztal et al.

(10) Patent No.: US 6,702,410 B2
(45) Date of Patent: Mar. 9, 2004

(54) DEVICE FOR SUPPORTING A KEYBOARD

(75) Inventors: Konrad Kusztal, Flourtown, PA (US); Joseph T. Williamson, Jr., Newark, DE (US); James J. Mackle, Voorhees, NJ (US); Stanley Kowalczuk, Bensalem, PA (US); Sidney Kleiman, Mount Laurel, NJ (US); Walter J. Hajduk, III, Medford, NJ (US)

(73) Assignee: H & H Industrial Corp., Pennsauken, NJ (US)

( * ) Notice: Subject to any disclaimer, the term of this patent is extended or adjusted under 35 U.S.C. 154(b) by 0 days.

(21) Appl. No.: 10/271,439

(22) Filed: Oct. 15, 2002

(65) Prior Publication Data

US 2003/0107305 A1 Jun. 12, 2003

Related U.S. Application Data

(60) Provisional application No. 60/329,483, filed on Oct. 15, 2001.

(51) Int. Cl.[7] ..... A47B 88/00

(52) U.S. Cl. ..... 312/302; 248/298.1; 248/298.31; 248/918; 312/319.2; 312/322

(58) Field of Search ..... 248/289.1, 289.31, 248/298.1, 299.1, 918, 279.1, 118.1; 312/208.1, 223.3, 265.4, 196, 223.2, 195, 283, 302, 322, 249.13, 249.2, 249.4, 249.5, 319.1, 319.2; 108/94, 93, 50.01, 139, 140; 361/683; 211/26

(56) References Cited

U.S. PATENT DOCUMENTS

| | | | | | |
|---|---|---|---|---|---|
| 4,657,214 | A | * | 4/1987 | Foster | 248/176.1 |
| 4,718,740 | A | * | 1/1988 | Cox | 312/223.2 |
| 5,562,049 | A | * | 10/1996 | Hoffman et al. | 108/94 |
| 5,636,822 | A | * | 6/1997 | Hendershot et al. | 248/346.01 |
| 5,683,064 | A | * | 11/1997 | Copeland et al. | 248/278.1 |
| 5,927,799 | A | * | 7/1999 | Tornero | 297/145 |
| 6,206,495 | B1 | * | 3/2001 | Peterson | 312/283 |
| 6,422,668 | B1 | * | 7/2002 | Kelley et al. | 312/195 |
| 6,527,234 | B1 | * | 3/2003 | Kovacik | 248/118.1 |
| 6,545,863 | B2 | * | 4/2003 | Huggins | 361/683 |
| 6,563,700 | B1 | * | 5/2003 | Waller et al. | 361/683 |

* cited by examiner

*Primary Examiner*—Ramon O. Ramirez
*Assistant Examiner*—Tan Le
(74) *Attorney, Agent, or Firm*—Robert F. Zielinski; Wolf, Block, Schorr & Solis-Cohen LLP

(57) ABSTRACT

A device for supporting a standard size keyboard tray within an electronics rack or cabinet. The keyboard supporting device includes a slideable shelf and a keyboard tray that is rotatably mounted thereto. The keyboard tray is rotatable between a storage position in which the keyboard tray is substantially perpendicular to the slideable shelf and a use position in which the keyboard tray is substantially parallel to the slideable shelf. A biasing device is included for biasing the keyboard tray toward either the storage position or the use position when the keyboard tray is disposed between the use position and the storage position.

16 Claims, 3 Drawing Sheets

DEVICE FOR SUPPORTING A KEYBOARD

This application claims the benefit of provisional application No. 60/329,483 filed Oct. 15, 2001.

FIELD OF THE INVENTION

This invention relates to accessories for electronics racks or cabinets, and more particularly to a device for supporting a keyboard for use in a standard electronics rack or cabinet.

BACKGROUND OF THE INVENTION

To date, electronics racks and cabinets have standardized on a size that is preferable to for most electronics devices. The EIA standard 19 inch cabinet is the most popular size of rack. These 19 inch electronics racks typically have an opening or a chassis clearance which is 17¾ inches wide to accommodate most types of electronic devices.

More and more, electronics racks are being called upon to store computer-related devices. These computer-related devices typically include a monitor, a central processing unit, and user interface devices such as a keyboard and a pointing device, such as a mouse. One problem which has resulted by the use of computer-related devices in electronics racks is that the standard size computer keyboard, which typically has 101 to 116 keys and a width of 17 to 20½ inches, does not fit into the 17¾ inches opening of the standard 19 inches electronics rack.

One way in which this problem has been solved in the past is by substituting a reduced size or mini-keyboard for the standard sized keyboard. This is usually accomplished by using smaller sized keys and/or removing sets of keys, such as the numeric keypad from the keyboard. Obviously, this results in decreased functionality of the keyboard by the user and is not an ideal solution to the problem.

The present invention solves the problem by the use of a rotatable keyboard supporting device which is capable of holding a full sized standard keyboard and storing the keyboard inside the cabinet when not in use.

SUMMARY

A device for supporting a standard size keyboard tray within an electronics rack or cabinet. The keyboard supporting device includes a slideable shelf and a keyboard tray that is rotatably mounted thereto. The keyboard tray is rotatable between a storage position in which the keyboard tray is substantially perpendicular to the slideable shelf and a use position in which the keyboard tray is substantially parallel to the slideable shelf. A biasing device is included for biasing the keyboard tray toward either the storage position or the use position when the keyboard tray is disposed between the use position and the storage position.

In one preferred form of the present invention, the biasing device includes an eccentrically mounted spring for biasing the keyboard tray. A cam-follower is provided for limiting the rotary motion of the keyboard tray and cooperates with the eccentric spring to bias the keyboard tray. In one form of the invention, the cam-follower comprises an arcuate track formed in either the slideable shelf or the keyboard tray and a follower that travels within the track disposed on the other of the slideable shelf and keyboard tray.

In one form of the invention, the slideable shelf may include drawer slides which permit the shelf to travel between an extended position and an unextended position. The stationary portion of the drawer slide is adapted to be slideably mounted to an electronics rack or cabinet.

In one form of the invention, a carousel is mounted between the slideable shelf and the keyboard tray for allowing the keyboard tray to rotate relative to the slideable shelf.

The keyboard tray may include a horizontal planar portion for holding a standard size keyboard, a wrist pad located at a front edge of the horizontal portion, and a cable management device, such as a slot, for managing the keyboard cable.

A handle may be provided on the slideable shelf for moving the shelf between the extended position and the unextended position.

BRIEF DESCRIPTION OF THE DRAWINGS

For the purpose of illustrating the invention, there is shown in the drawings a form which is presently preferred; it being understood, however, that the invention is not limited to the precise arrangements and instrumentalities shown.

DETAILED DESCRIPTION OF THE PREFERRED EMBODIMENTS

Figure 1:
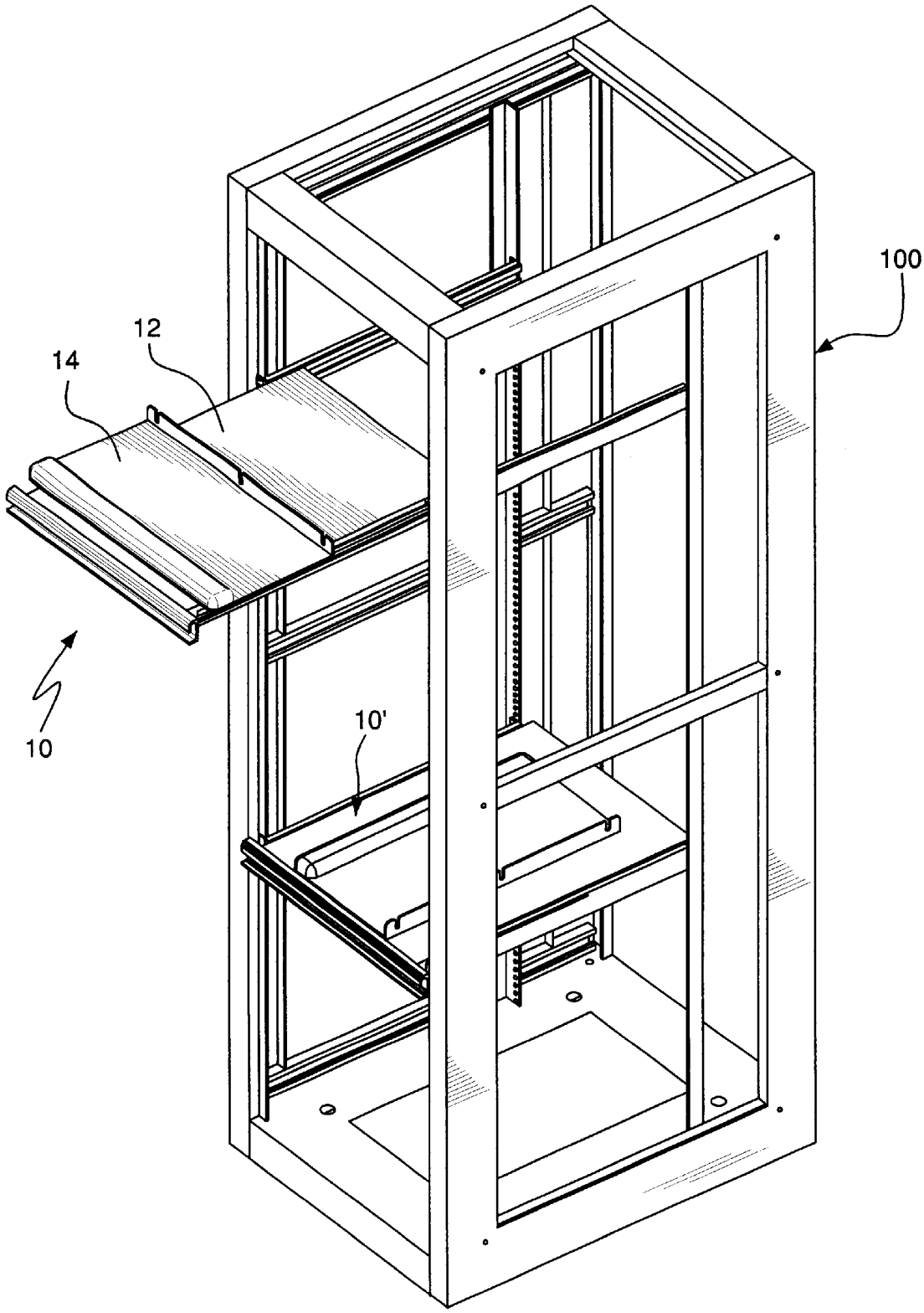
FIG. 1 shows an isometric view of the keyboard supporting device of the present invention mounted within a standard electronics cabinet or rack.

In FIG. 1 there is shown a keyboard supporting device in accordance with the present invention. The keyboard supporting device is shown mounted to an electronics cabinet or rack 100. Typically, the electronics rack or cabinet 100 is an EIA standard 19 inch enclosure having a typically chassis opening or internal clearance of 17¾ inches wide.

The keyboard supporting device 10 includes a slideable shelf 12 and a keyboard tray 14 rotatably mounted to the slideable shelf 12. The keyboard tray 14 is sized to accommodate a standard sized keyboard having approximately 101 to 116 keys and is typically between 17 inches and 20½ inches wide. As such, the standard sized keyboard is usually too large to fit into a standard 19 inch electronics rack or cabinet.

Figure 4:
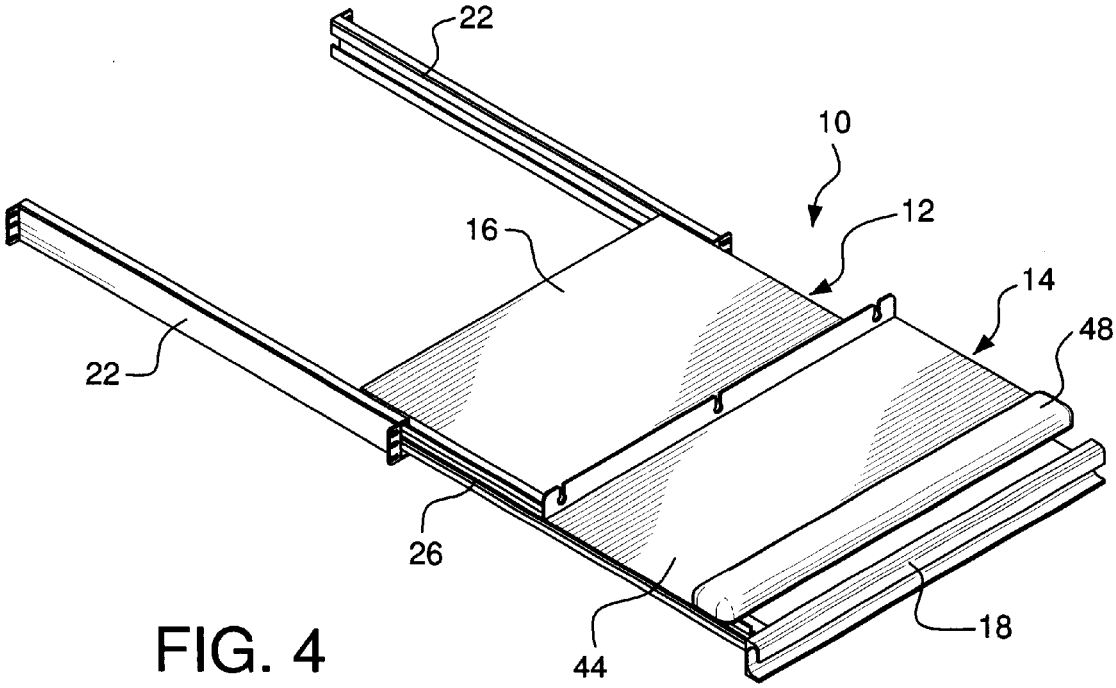
FIG. 4 shows an isometric view of the keyboard supporting device of FIG. 2 in an extended position.

In FIGS. 1 and 4, the keyboard tray 14 is shown in the typical use position in which the keyboard tray is substantially parallel to the slideable shelf and the slideable shelf is in an extended position in which the user has ready access to a keyboard disposed on the keyboard tray 10. With the keyboard tray in this use position, a standard sized conventional keyboard will not fit within the electronics cabinet as described above. The keyboard tray may be rotated 90° so that it is perpendicular to the slideable shelf for facilitating the storage of the keyboard supporting device 10 within the electronics rack or cabinet 100.

Figure 3:
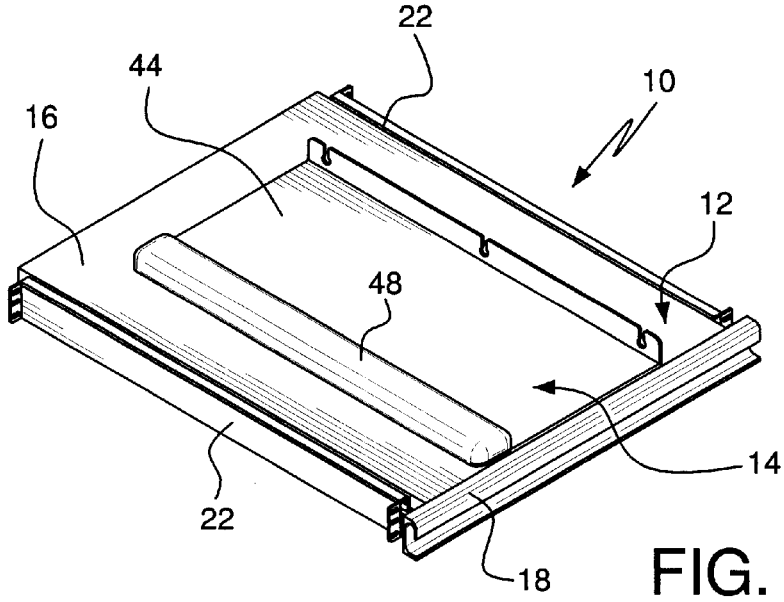
FIG. 3 shows an isometric view of the keyboard supporting device of FIG. 2 in an unextended position.

A keyboard supporting device 10' is shown in such a storage position within the electronics rack or cabinet in FIGS. 1 and 3. The keyboard supporting device 10' is shown in a storage position in which the keyboard tray is substantially perpendicular to the slideable shelf and the slideable shelf is disposed in an unextended position. In this way, even a keyboard that is wider than the opening of the electronics cabinet or rack may be easily stored within the rack itself.

Figure 2:
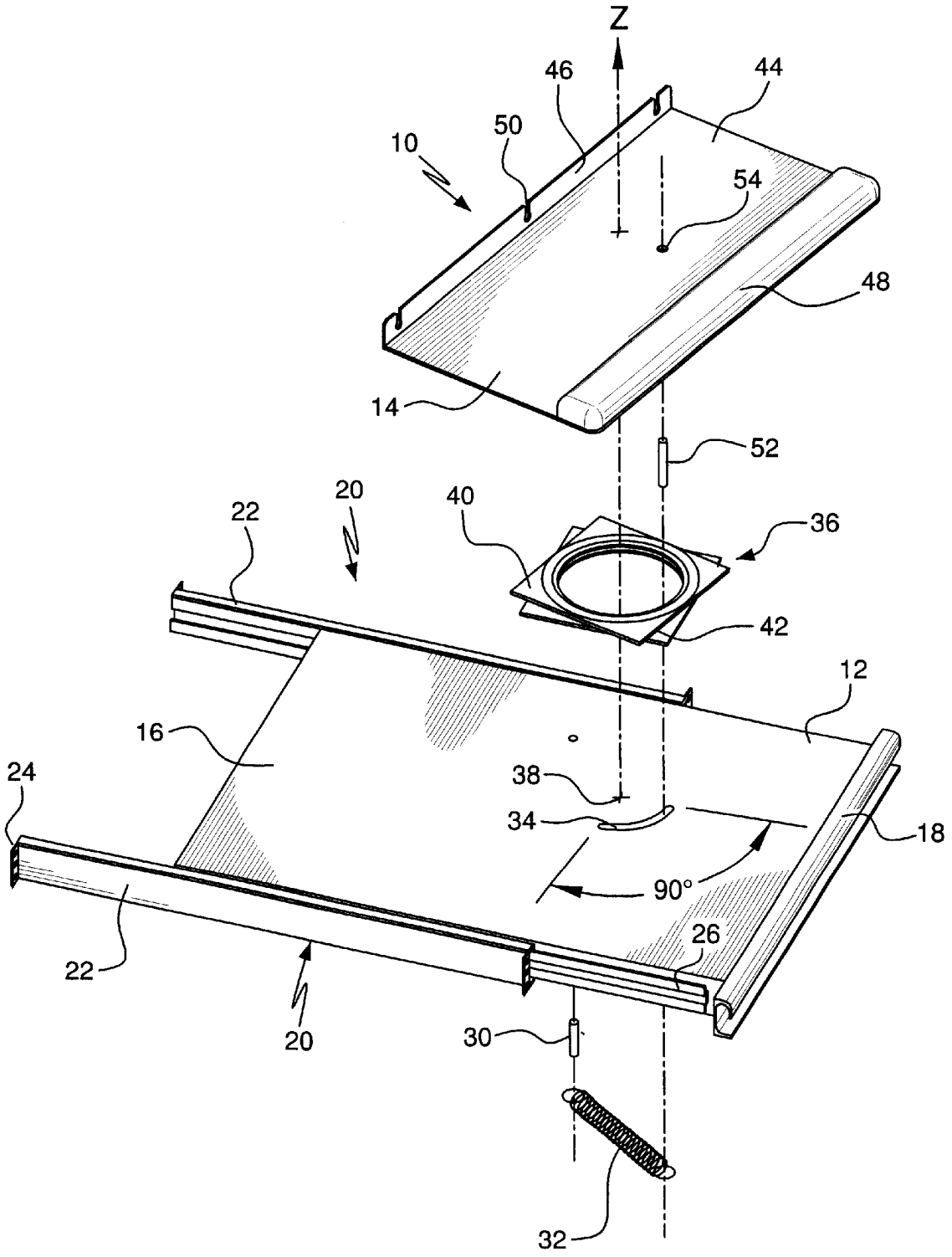
FIG. 2 shows an exploded view of the keyboard supporting device of the present invention.

The keyboard supporting device 10 is shown in greater detail in FIG. 2. The slideable shelf 12 includes a substantially planar shelf portion 16 having a handle 18 located on a front edge. The handle 18 is shown as a standard C channel bracket, but it should be understood that the handle may take any suitable shape which permits a user to easily grasp the slideable shelf 12 and move the shelf between the unextended and the extended positions. A pair of drawer slides 20 are mounted to opposite sides of the shelf 16.

The drawer slides include a stationary portion 22 and a slideable portion 24. The stationary portion 22 of the drawer slide 20 typically includes a mounting portion 24, such as the outwardly turned flange shown, for mounting the shelf 12 to the rack 100. The slideable portion 24 of the drawer slide 20 is mounted to the shelf portion 16 and slides within the stationary portion 22 mounted to the rack 100 so that the slideable shelf 12 may travel between the extended and the unextended positions. It should be understood that the manner of attaching the drawer slide, the location of the drawer slides and the manner of mounting the drawer slides to the rack is dependent upon the design of the electronics rack and it is within the scope of the present invention to provide a suitable drawer slide and mounting scheme to accommodate any rack design.

The slideable shelf 12 includes a connection point 28 on the underside of the shelf on which is mounted and elongated dowel 30 which extends downwardly from shelf 16. The dowel 30 is provided for attaching one end of a spring 32, as described in greater detail below. An arcuate slot 34 is also formed in the planar shelf portion 16.

A rotatable connector 36 is disposed between the shelf 12 and the keyboard tray 14 for permitting the rotation of the keyboard shelf 14 relative to the shelf 12. One such rotatable connector 14 is shown in FIG. 2 in the form of a carousel which is centered on 38 on the shelf 12. The carousel 36 has a first portion 40 which is mounted to the keyboard tray 14 and a second portion 42 which is mounted to the shelf portion 16. Portions 40 and 42 are capable of rotating relative to each other and permit the rotation of the keyboard tray 14. It should be understood that the rotatable connection can take many different forms which would be suitable for the present invention including a lazy Susan-type connection, a ball bearing connection, an axle-type connection, or the like.

The keyboard shelf 14 includes a planar horizontal portion 44 and an upturned planar vertical portion 46. A padded wrist rest 48 is located on a front edge of the planar horizontal portion 44. Cable management slots 50 are disposed along the upturned planar vertical portion 46 for managing the cable of a keyboard supported on the keyboard tray 14. It should be understood that other cable management devices can be used along with the slots 50 or in place of the slots 50, as desired.

An elongated dowel 52 is mounted to the underside of the horizontal planar position 16. The elongated dowel 52 is mounted to the underside of the horizontal portion 44 of the keyboard tray 14 at connection point 54. When the keyboard tray 14 is assembled to the slideable shelf 12, the elongated dowel 52 cooperates with and extends through the arcuate track 34 and passes through the underside edge of the horizontal planar shelf 16 so that the other end of the spring 32 may be attached thereto. When the keyboard tray 14 is rotated between the perpendicular storage position and the parallel use position, the dowel 52 travels within the arcuate slot 34. As such, it is contemplated that the arcuate slot subtends a 90° angle and, in the preferred embodiment, the arcuate slot 34 forms a quarter circle.

The dowel 52 and the arcuate slot 34 form a cam-follower assembly. In addition, the biasing spring 32 is attached at one end to the dowel 30 that is fixedly attached to the underside of the shelf 16 at one end and is attached at the other end to the dowel 52 that is attached to the rotatable shelf 44 to form a biasing device for biasing the keyboard tray 14 relative to the shelf 12. Together, the cam-follower and the biasing device form a biasing assembly that functions to bias the keyboard tray 14 to either the storage position (located at one end of the arcuate track 34) or the use position (located at the other end of the arcuate track 34).

This biasing functionality is achieved because the arrangement and location of the arcuate track 34 relative to the fixed dowel 30 on the shelf 16 is such that as the keyboard tray 14 is rotated and the moveable dowel 52 travels along the arcuate track 34 away from the fixed dowel 30 which serves to stretch the spring 32. This stretching of the spring increases until it reaches its maximum point at the half-way point between the two ends of the arcuate track 34. The stretching of the spring 32 serves to create a spring force in the direction of the fixed dowel 30 when at the midpoint of the arcuate track 34.

The arcuate slot 34 is symmetrical about a line shown perpendicular through the tangent at the midpoint. When the moveable dowel 52 is on either side of the midpoint of the arcuate slot 34, the spring force has a component directed toward the closer end of the arcuate track and serves to bias the moveable dowel (and in turn the keyboard tray 14) toward the closer end of the arcuate track 34. In this way, the keyboard tray 14 is biased in either the use position of FIG. 4 or the storage position of FIG. 3.

Thus, the eccentrically installed tension spring 7 relative to the Z axis of the keyboard tray 14 and shelf 12 facilitates a smooth turning function of the rotatable keyboard tray 12 and holds the keyboard tray 12 in either the use position or the storage position. The present design allows for easy self-adjustment between the two positions and eliminates the possibility of damage to the keyboard shelf 10 or the rack 100 that may result when the drawer assembly is accidentally rolled in with the keyboard drawer in the perpendicular use position.

In use, a user grasps the handle 18 of the slideable drawer 12 to extend the drawer 12 from the unextended position within an electronics cabinet to an extended position outside of the electronics cabinet. When the shelf 12 is in the extended position the keyboard tray 14 may be rotated from the storage position in which the keyboard tray is substantially perpendicular to the slideable shelf to the use position, shown in FIG. 4, in which the keyboard tray is substantially parallel to the slideable shelf. The biasing assembly serves to bias the keyboard tray in the use position in which the removable dowel 52 is disposed at the far end of the arcuate track 34 in which the force of the tension spring 32 is directed at least partly in the direction toward the far end of the arcuate track.

When the user desires to store the keyboard supporting device 10, the user rotates the shelf 14 back into the storage position against the force of the tension spring 7 at least until the moveable dowel 52 reaches the midpoint position of the arcuate slot 34. At that point, the tension spring 32 exerts a force on the keyboard tray 14 to bias it toward the opposite end of the arcuate slot 34, which is the storage position. In this storage position, the tension spring 32 exerts a force on the moveable dowel which biases the dowel towards this opposite end of the arcuate slot 34 and locks the keyboard tray 14 in the storage position. When the keyboard tray 14 is in the storage position, the slideable shelf 12 may be retracted back into the electronics rack 100 into the unextended position for safe storage of the shelf within the rack.

Other modifications of the keyboard supporting device 10 are also contemplated by the present invention. For example, a mouse holder may be provided in conjunction with the keyboard tray 14 for holding a conventional mouse or pointing device. It should also be understood that a variety of different types of springs having different spring constants and the like may also be employed for the coil spring 32 depicted in the drawings.

The present invention may be embodied in other specific forms without departing from the spirit or essentially attributes thereof and, accordingly, reference should be made to the appended claims, rather than to the foregoing specification, as indicating the scope of the invention.

What is claimed is:

1. A device for support a keyboard comprising:

a slideable shelf;

a keyboard tray rotatably mounted to the slideable shelf, the keyboard tray is rotatable between a storage position in which the keyboard tray is substantially perpendicular to the slideable shelf and a use position in which the keyboard tray is substantially parallel to the slideable shelf; and a means for biasing the keyboard tray toward either the storage position or the use position when the keyboard tray is disposed between the use position and the storage position.

2. The keyboard supporting device according to claim 1, wherein the biasing means comprises an eccentrically mounted spring for biasing the keyboard tray.

3. The keyboard supporting device according to claim 2, wherein the biasing means further comprises a cam-follower for limiting the rotary motion of the keyboard tray, the cam-follower cooperates with the eccentric spring to bias the keyboard tray.

4. The keyboard supporting device according to claim 3, wherein the cam-follower comprises an accurate track formed in one of the slideable shelf and keyboard tray and a follower that travels within the track disposed on the other of the slideable shelf and keyboard tray.

5. The keyboard supporting device according to claim 1, wherein the slideable shelf includes drawer slides which permit the shelf to travel between an extended position and an unextended position.

6. The keyboard supporting device according to claim 1, further comprising a carousel mounted between the slideable shelf and the keyboard tray which allows the keyboard tray to rotate to the slideable shelf.

7. The keyboard supporting device according to claim 1, wherein the keyboard tray comprises a horizontal planar portion for holding a standard-size keyboard, a wrist pad located at a front edge of the horizontal portion, and a cable management device for managing a keyboard cable.

8. The keyboard supporting device according to claim 1, wherein the slideable shelf is adapted to be slideably mounted to an electronics rack or cabinet.

9. The keyboard supporting device according to claim 5, wherein a stationary portion of the drawer slide is adapted to be slideably mounted to an electronics rack or cabinet.

10. The keyboard supporting device according to claim 5, wherein the slideable shelf includes a handle for moving the shelf between the extended and unextended positions.

11. A device for supporting a keyboard tray comprising:

a slideable shelf, the slideable shelf comprising drawer slides for allowing the shelf to travel between an extended position and an unextended position;

a keyboard tray rotatably mounted to the slideable shelf, the keyboard tray being rotatable between a storage position in which the keyboard tray is substantially perpendicular to the slideable shelf and a use position in which the keyboard tray is substantially parallel to the slideable shelf; and a biasing assembly for biasing the keyboard tray toward either the storage position or the use position when the keyboard tray is disposed between the use position and the storage position, the biasing assembly comprising an eccentrically mounted spring and a cam-follower for limiting the rotary motion of the keyboard tray, the cam-follower cooperating with the eccentric spring to bias the keyboard tray.

12. The keyboard supporting device according to claim 11, wherein the cam-follower comprises an accurate track formed in one of the slideable shelf and keyboard tray and a follower that travels within the track disposed on the other of the slideable shelf and keyboard tray.

13. The keyboard supporting device according to claim 11, further comprising a carousel mounted between the slideable shelf and the keyboard tray which allows the keyboard tray to rotate to the slideable shelf.

14. The keyboard supporting device according to claim 11, wherein the keyboard tray comprises a horizontal planar portion for holding a standard-size keyboard, a wrist pad located at a front edge of the horizontal portion, and a cable management device for managing a keyboard cable.

15. The keyboard supporting device according to claim 11, wherein a stationary portion of the drawer slide is adapted to be slideably mounted to an electronics rack or cabinet.

16. The keyboard supporting device according to claim 11, wherein the slideable shelf includes a handle for moving the shelf between the extended and unextended positions.

* * * * *